US010954018B2

(12) United States Patent
Benterman et al.

(10) Patent No.: US 10,954,018 B2
(45) Date of Patent: Mar. 23, 2021

(54) CONTAINER SIZING METHOD AND SYSTEM

(71) Applicant: WestRock Linkx Systems Limited, Suffolk (GB)

(72) Inventors: Daniel Benterman, Suffolk (GB); David Hayward, Suffolk (GB)

(73) Assignee: Westrock Linkx Systems Limited, Nottingham (GB)

( * ) Notice: Subject to any disclaimer, the term of this patent is extended or adjusted under 35 U.S.C. 154(b) by 906 days.

(21) Appl. No.: 14/406,158

(22) PCT Filed: Jun. 4, 2013

(86) PCT No.: PCT/GB2013/051479

§ 371 (c)(1),
(2) Date: Dec. 5, 2014

(87) PCT Pub. No.: WO2013/182845

PCT Pub. Date: Dec. 12, 2013

(65) Prior Publication Data

US 2015/0119216 A1 Apr. 30, 2015

(30) Foreign Application Priority Data

Jun. 8, 2012 (GB) ..... 1210170.5

(51) Int. Cl.
*B65B 59/02* (2006.01)
*B65B 5/02* (2006.01)
(Continued)

(52) U.S. Cl.
CPC ..... *B65B 59/02* (2013.01); *B65B 5/024* (2013.01); *B65B 59/001* (2019.05);
(Continued)

(58) Field of Classification Search
CPC ..... B65B 2210/04; B65B 59/02; B65B 59/00; B65B 5/024; B65B 5/02; B65B 5/00; B31B 49/02; B31B 49/00; B31B 2201/98
(Continued)

(56) References Cited

U.S. PATENT DOCUMENTS 3,015,197 A * 1/1962 Eichorn ..... B65B 5/024 493/352
3,272,042 A 9/1966 Haas
(Continued)

FOREIGN PATENT DOCUMENTS

CN 101450539 A 6/2009
DE 202012002173 U 6/2012
(Continued)

OTHER PUBLICATIONS

International Search Report dated Nov. 13, 2013 issued in corresponding International Patent Application No. PCT/GB2013/041479.

(Continued)

*Primary Examiner* — Gloria R Weeks
(74) *Attorney, Agent, or Firm* — John B. Swingle

(57) ABSTRACT

A carton sizing system (1) that has a frame (2), a controller (4), one or more cutters (51) movably mounted to the frame (2) and operatively connected to the controller (4), one or more markers (61) movably mounted to the frame (2) and operatively connected to the controller (4). The carton sizing system (1) also has a measuring system (7) that is operatively connected to the controller (4) and configured to determine, in use, the footprint of an open top carton and to determine the height of one or more objects contained within the carton. The controller (4) is configured to position the one or more cutters (51) based on the determined footprint and to cut vertical edges of the carton based on the deter-
(Continued)

mined height and also to position the one or more markers (61) based on the determined footprint and eight and to score or crease vertical walls of the carton between the vertical edges to at least partially define foldable panels.

20 Claims, 7 Drawing Sheets

(51) Int. Cl.
*B65B 59/00* (2006.01)
*B31B 50/00* (2017.01)

(52) U.S. Cl.
CPC ..... *B65B 59/003* (2019.05); *B31B 50/006* (2017.08); *B31B 2241/00* (2013.01); *B65B 2210/04* (2013.01)

(58) Field of Classification Search
USPC .... 493/22; 53/52, 296, 381.2, 491, 493, 504
See application file for complete search history.

(56) References Cited

U.S. PATENT DOCUMENTS 3,922,778 A * 12/1975 Aalpoel ..... B65B 69/0033 30/2
3,953,956 A * 5/1976 Massman ..... B65B 7/20 493/60
4,430,842 A * 2/1984 Focke ..... B65B 11/02 53/220
4,562,686 A * 1/1986 Focke ..... B65B 61/00 493/183
4,821,203 A * 4/1989 Carlton ..... G05B 19/25 493/25
5,873,807 A * 2/1999 Lauderbaugh ..... B31B 1/00 493/403
5,991,041 A * 11/1999 Woodworth ..... G01B 11/04 356/602
6,430,899 B1 * 8/2002 Cicha ..... B31B 1/00 493/165
7,587,884 B2 * 9/2009 Durand ..... B65B 7/16 53/376.4
7,720,567 B2 * 5/2010 Doke ..... B25J 9/0093 700/230
7,823,367 B2 * 11/2010 Boigues ..... B65B 5/02 53/376.3
7,849,776 B2 * 12/2010 Hilgendorf ..... B26D 1/157 414/412
8,109,062 B2 * 2/2012 Chase ..... B65B 7/20 53/377.2
8,463,428 B2 * 6/2013 Doke ..... B25J 9/0093 700/230
9,434,496 B2 * 9/2016 Sytema ..... B31B 1/25
2007/0199648 A1 * 8/2007 Hulverscheidt, Jr. ..... B26F 1/3813 156/252
2009/0031676 A1 2/2009 Boigues et al.
2009/0173040 A1 * 7/2009 Carlson ..... B65B 55/20 53/250
2014/0013709 A1 * 1/2014 Ceyssens ..... B65B 51/00 53/285
2015/0210418 A1 * 7/2015 Cheich ..... B65B 51/067 53/471
2016/0185065 A1 * 6/2016 Sytema ..... B31B 1/52 493/180
2016/0185475 A1 * 6/2016 Pettersson ..... B65B 59/02 53/493
2017/0001746 A1 * 1/2017 Dominici ..... B65B 51/00

FOREIGN PATENT DOCUMENTS

EP 0645309 A1 3/1995
EP 1832413 A1 9/2007
FR 2606367 A1 5/1988
WO 3846420 A1 10/1998
WO 2005000570 A2 1/2005
WO WO 2016151310 A1 * 9/2016 ..... B65B 59/02

OTHER PUBLICATIONS

Office Action dated Jun. 4, 2013 in corresponding Brazilian Application No. BR1120140307245.
Office Action dated Nov. 18, 2019 in corresponding Canadian Patent Application No. 2,912,503.
Office action dated Jul. 31, 2019 in corresponding Indian Patent Application No. 153/DELNP/2015.
Extended European search report issued in corresponding EP application No. 19218705.2, dated Apr. 3, 2020.

* cited by examiner

CONTAINER SIZING METHOD AND SYSTEM

This invention relates generally to a container sizing method and device or system for modifying the dimensions of a container. More specifically, although not exclusively, this invention relates to a container or box or carton sizing method and device or system for altering the size of a box or carton to suit its contents.

One application in which carton sizing devices are particularly useful is in the field of made-to-order packages, wherein orders are placed for varying product types and quantities and packages containing such products must be prepared for shipment. These applications result in an infinite number of combinations of products that are placed in standard sized cartons and so they occupy varying heights and volumes within such cartons. Package shipment costs are generally dependent upon both the weight and dimensions of the package to be shipped. The wide variation in filling level often results in a void at the top of the carton, requiring additional packing material, leading to waste, and unnecessarily large carton sizes, leading to higher shipping costs.

Known solutions to this issue involve the use of a single carton blank size that is modified in some way to suit the contents to be packed. EP0645309, for example, discloses a cartoning system in which the erected carton is cut to a height equivalent to the contents to be packed. The excess material is then discarded and a lid is placed on the open top, which results in wasted material.

FR2612885 proposes a carton blank in which upper foldable panels are provided with a plurality of fold lines so that the most appropriate fold line can be selected to suit the height of the contents to be packed. The adaptability of such cartons is limited to the intervals between the fold lines, bespoke carton blanks are required, which can be expensive, and the multiple fold lines can cause problems in the erection and closure of the cartons in use.

FR2606367 discloses a cartoning system in which the carton blanks are creased before they are erected and filled on the basis of a known configuration of contents to be packed. This arrangement requires prior knowledge of the contents to be packed and is particularly suited to short production runs of the same content configuration, where a plurality of such carton configurations will be required. In the aforementioned made-to-order packages, the contents of each package tend to be bespoke and the products are not generally brought together and stacked prior to the carton being erected in such a way that would suit this system.

U.S. Pat. No. 3,953,956 describes a cartoning system in which a prefilled open top carton is scored at the height of the contents, the upper portion of the vertical corners are cut down to the level of the score lines to create flaps defined by the score lines, cut corners and upper edge and the side flaps are cut to less than half the width of the carton so they do not overlap when folded down. The cartoning system is reconfigurable to accommodate different carton sizes by removing and replacing the scoring blades and pressing members mounted to a subframe by screws to suit the carton size and adjusting the subframe by means of adjustment screws. As with FR260367, this arrangement is particularly suited to short production runs, where a plurality of such carton configurations will be required, but is not very well suited to made-to-order packages in which the required carton configuration varies widely and from one package to the next.

It is therefore a first non-exclusive object of the present invention to provide a container sizing device that is particularly suited to made-to-order packaging applications. It is a further, more general non-exclusive object of the invention to provide an improved container sizing device, preferably one which at least mitigates one or more issues with prior art devices.

According to a first aspect of the invention, there is provided a container or carton sizing system comprising a frame or gantry, a controller, one or more cutters movably mounted to the frame or gantry and operatively connected to the controller, one or more markers movably mounted to the frame or gantry and operatively connected to the controller and measuring means operatively connected to the controller and configured to determine, in use, the footprint of an open top container or carton and to determine the height of one or more objects contained within the container or carton, wherein the controller is arranged or configured or programmed to position the one or more cutters based on the determined footprint and to cut vertical edges of the container or carton based on the determined height, the controller being further arranged or configured or programmed to position the one or more markers based on the determined footprint and height and to score or crease vertical walls of the container or carton between the vertical edges, e.g. to define foldable panels.

This arrangement provides a more flexible, yet simple solution that is adaptable dynamically to suit containers or cartons of different sizes.

The one or more cutters are preferably movable along two or more, preferably three or more axes, e.g. to selectively position and/or orient one or more or each cutter. At least one of the cutters may comprise a cutting edge and/or be mounted to a mount or jig, e.g. that is movably mounted with respect to the frame or gantry.

In a particularly preferred embodiment, at least one cutter or cutting element or edge of the cutter is mounted to an arm, such as a robotic or articulated arm, for example to the end of a robotic or articulated arm, that may be movable about multiple axes, e.g. three or more axes. The arm may comprise a three, four, five or six axis articulated robotic arm. Additionally or alternatively, the arm may form part of or be comprised in a cartesian robot or robotic gantry system.

In some embodiments, the controller is arranged or configured or programmed to position, in use, the cutter or one of the cutters to cut a first vertical edge and then to position the same cutter to cut a second vertical edge, different from the first vertical edge. The controller may further be arranged or configured or programmed to position the same cutter to cut a third vertical edge, different from the first and second vertical edges. The controller may further be arranged or configured or programmed to position the same cutter to cut a fourth vertical edge and/or one or more further vertical edges, different from the first, second, third and/or any other vertical edges.

The one or more markers are preferably movable along two or more, preferably three or more axes, e.g. to selectively position and/or orient one or more or each marker. At least one of the markers may be mounted to a mount or jig that is movably mounted with respect to the frame or gantry.

In a particularly preferred embodiment, at least one marker or marking element or marking surface or marking edge is mounted to an arm, such as a robotic or articulated arm, for example to the end of a robotic or articulated arm, that may be movable about multiple axes, e.g. three or more axes. The arm may comprise a three, four, five or six axis robotic arm. Additionally or alternatively, the arm may form part of or be comprised in a cartesian robot or robotic gantry system.

In some embodiments, the controller is arranged or configured or programmed to position, in use, the marker or one of the markers to score or crease a first vertical wall, e.g. between a first pair of the vertical edges, and then to position the same marker to crease a second vertical wall, different from the first vertical wall, e.g. between a second pair of the vertical edges. The controller may further be arranged or configured or programmed to position the same marker to score or crease a third vertical wall, different from the first and second vertical walls, e.g. between a third pair of the vertical edges. The controller may further be arranged or configured or programmed to position the same marker to score or crease a fourth vertical wall and/or one or more further vertical walls, different from the first, second, third and/or any other vertical walls, e.g. between a fourth and/or one or more further pairs of the vertical edges.

In a particularly preferred embodiment, the measuring means comprises a vision system or imaging system or camera, which may be configured to capture one or more images from one or more positions or angles. The controller or a controller or processor of the vision system or imaging system or camera is preferably arranged or configured or programmed to determine or measure, in use, e.g. from a captured image or images, one or more features or dimensions of the container or carton or its contents, for example any one or more of the height of one or more objects contained in the container or carton, a width and/or length and/or height of the container or carton and a thickness of the container or carton.

Additionally or alternatively, the measuring means may comprise one or more sensors for measuring or determining, in use, one or more dimensions of the container or carton or its contents, for example any one or more of the height of one or more objects contained in the container or carton, a width and/or length and/or height of the container or carton and a thickness of the container or carton. The one or more sensors may comprise any suitable measurement sensors.

The controller is preferably arranged or configured or programmed to determine or calculate the required cutter position and/or orientation for cutting one or more, e.g. each, of the vertical edges of the container or carton, for example based on the measured or determined one or more dimensions of the container or carton or its contents, e.g. based on any one or more of the measured or determined height of one or more objects contained in the container or carton, width and/or length and/or height of the container or carton and thickness of the container or carton.

Additionally or alternatively, the controller is preferably arranged or configured or programmed to determine or calculate the required marker position and/or orientation for scoring or creasing one or more, e.g. each, of the vertical walls of the container or carton, for example based on the measured or determined one or more dimensions of the container or carton or its contents, e.g. based on any one or more of the measured or determined height of one or more objects contained in the container or carton, width and/or length and/or height of the container or carton and thickness of the container or carton.

The cutter preferably comprises a blade that may be movably or pivotally mounted to a support or support block and/or a guard that may also be mounted or secured to the support or support block, for example wherein the blade may be movable or pivotable between a deployed position or condition in which a corner or edge of the blade is exposed for cutting and/or a retracted position or condition, for example in which it is at least partially covered or concealed by or within the guard. The cutter more preferably includes an actuator or drive means, e.g. for moving the blade between the retracted and deployed positions or conditions. The actuator or drive means may be operatively connected, e.g. pivotally connected, to the support or support block and/or to the blade, for example by an extension arm that may be integral with or secured to the blade and/or that may extend at an angle or orthogonally with respect to the or a cutting edge of the blade. The actuator or drive means may comprise a pneumatic or hydraulic actuator or cylinder or an electromechanical actuator or any other suitable actuator or drive means.

In an alternative embodiment, the cutter may comprise an anvil member or element which may be mounted to an articulated arm, for example to the end of an articulated arm, that may be movable about multiple axes, e.g. three or more axes, and a blade that is mounted on an articulated arm, for example to the end of an articulated arm, that may be movable about multiple axes, e.g. three or more axes. The articulated arm(s) may comprise a three, four, five or six axis articulated arm, such as a robotic arm. The robotic arm may be part of a gantry robot positioning system, for example a four axis gantry robot positioning system. Such a cutter may be suitable for cutting corners, for example where the anvil member or element may be moved relative to the external surface of the container or carton and the blade remains inside the container or carton and the carton or container may be cut when the blade is moved toward the anvil member or element.

The marker may comprise creaser and/or a scorer for creasing and/or scoring the or each or one of the vertical walls of the container or carton. In some embodiments, the marker comprises a projection or blade member or element, which may be dull such as for creasing the vertical wall or sharp such as for scoring the vertical wall, and/or an anvil member or element, for example against which the projection or blade member or element may be urged in order to create a crease or score mark or line. The projection or blade member or element may comprise a creasing or scoring edge and/or the anvil member or element may comprise a flat anvil surface or, preferably, a depression within which the creasing or scoring edge of the projection or blade member or element is received in use. The projection or blade member or element and/or the creasing or scoring edge and/or the anvil member or element and/or the anvil surface or depression may be sized and/or dimensioned and/or configured to be less than a carton to be creased, for example wherein each carton wall to be creased is creased multiple times. In some embodiments the marker comprises a pair of rollers between which the wall is compressed and scored or creased by moving the rollers, e.g. the arm, along the wall. One of the rollers may comprise the projection or blade member or element and/or the anvil member or element.

The marker may comprise a base from which extend a pair of arms, each of which incorporates or includes one of the projection or blade member or element and the anvil member or element. One of the arms may be fixed or secured relative to the base and/or the other of the arms may be pivotally connected or coupled to or relative to the base. The marker may further comprise an actuator or drive means, e.g. for moving the pivotable arm relative to the fixed or secured arm such as to selectively separate or bring together the projection or blade member or element and the anvil member or element. The actuator or drive means may be operatively connected, e.g. pivotally connected, to the base or fixed or secured arm, for example by an extension arm that may be integral with or secured to the fixed or secured arm and/or that may extend at an angle or orthogonally with respect to the anvil member, for example with respect to the anvil surface. The actuator or drive means may be operatively connected, e.g. pivotally connected, to the pivotable arm, for example by an extension arm that may be integral with or secured to the pivotable arm and/or that may extend at an angle or orthogonally with respect to the projection or blade member or element, for example with respect to the creasing or scoring edge. The actuator or drive means may comprise a pneumatic or hydraulic actuator or cylinder or an electromechanical actuator or any other suitable actuator or drive means.

According to a second aspect of the invention, there is provided a container or carton erecting system or a cartoning system comprising a container or carton sizing system as described above. The container or carton erecting system or a cartoning system may further comprise any one or more of a carton blank feeding station, an erecting station, a folding and/or closing and/or gluing and/or taping station, a strapping station, a stacking station and a palletising station.

According to a third aspect of the invention, there is provided a method of forming a container or carton, for example using a device as described above, the method comprising determining the footprint of an open top container or carton using measuring means, determining the height of one or more objects contained within the container or carton using the measuring means, automatically determining the position of the vertical edges of the container or carton based on the determined footprint using a controller, automatically determining the required height of the container or carton based on the determined height of the one or more objects using the controller, causing the controller to position the one or more cutters to a position adjacent each of the vertical edges, cutting each of the vertical edges between an upper edge of the container or carton and a position at or adjacent the required container or carton height, causing the controller to position the one or more markers to a position adjacent each of the vertical walls and scoring or creasing each of the vertical walls between the vertical edges at a position at or adjacent the required container or carton height, for example such that one or more foldable flaps or panels are defined in the vertical walls, e.g. between the score or crease lines and/or the cut vertical edges and/or the upper edge of the container or carton.

The method according to this aspect of the invention may comprise one or more steps relating to the implementation of any of the features of configuration of the device according to the first aspect of the invention.

The cutting step may comprise deploying a cutting blade from a retracted position or condition to a deployed position or condition. The cutting step may comprise moving a single cutter from adjacent a first vertical edge to a second vertical edge, e.g. different from the first vertical edge, for example such that the single cutter cuts two or more, for example all, of the vertical edges.

The scoring or creasing step may comprise actuating the marker, for example to bring blade and anvil elements thereof together, e.g. to score crease a first of the vertical walls or only a portion of the first vertical wall. The marker may then be operated to separate the blade and anvil elements and/or may be moved along the first carton wall, such as to an adjacent portion there, e.g. which may then be scored or creased. The marker may then be moved and/or reoriented, such as to repeat one or more of the aforementioned steps in relation to one or more further vertical carton walls, for example all of the vertical carton walls.

The method preferably comprises the further step of folding one or more, preferably each, of the foldable flaps or panels, for example using the or a folding and/or closing and/or gluing and/or taping station.

For the avoidance of doubt, the term 'vertical' as used herein is intended to mean extending generally vertically rather than a specific orientation. Similarly, the term 'controller' is intended to mean any suitable control system including, but not limited to, a single unit with a single or multiple processors, multiple units with one or more processors that need not be physically connected together.

Embodiments of the invention will now be described by way of example only with reference to the accompanying drawings in which.

Figure 1:
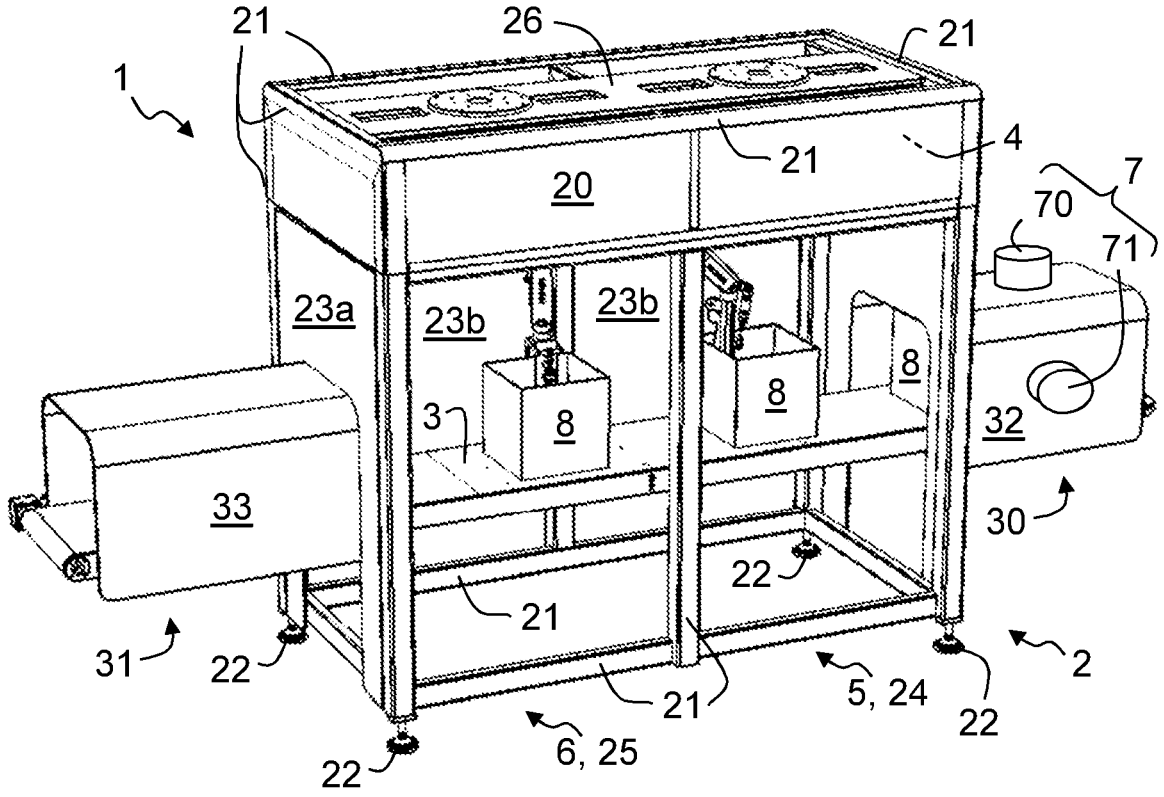
FIG. 1 is a perspective view of a carton sizing system according to one embodiment of the invention with the front guards omitted for illustrative purposes.
Figure 2:
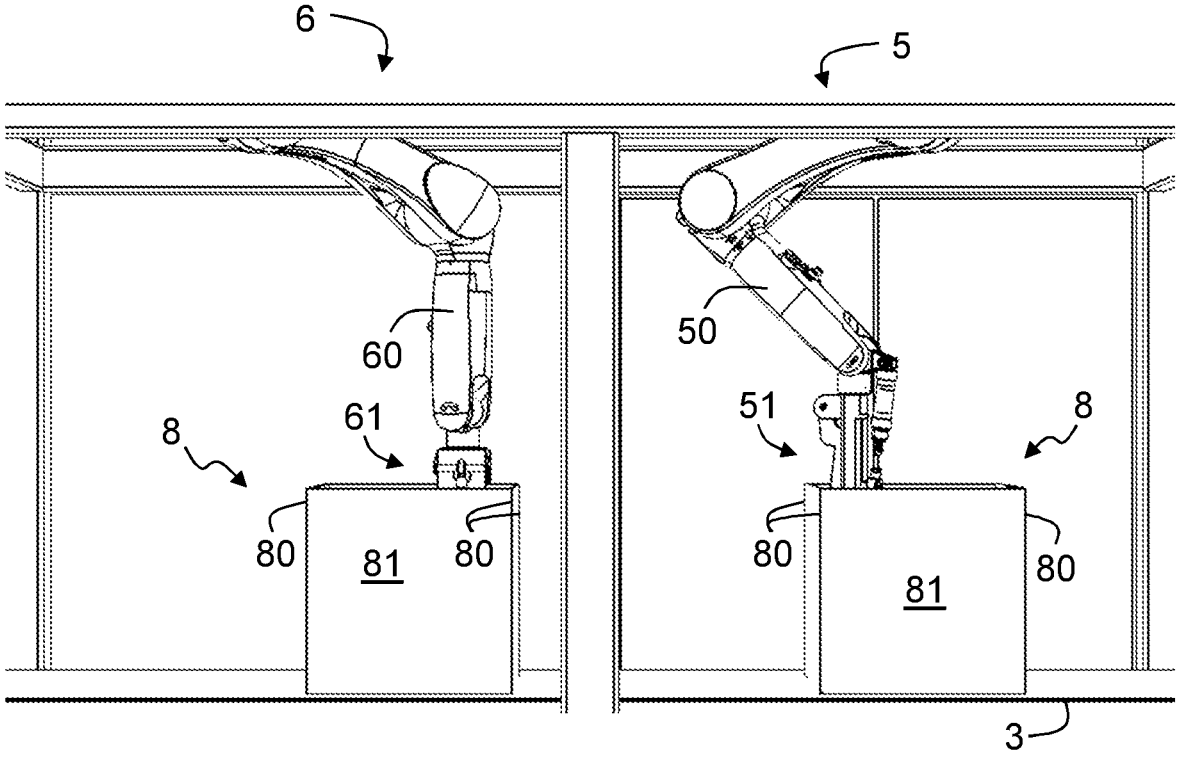
FIG. 2 is a partial front view of the device of FIG. 1 showing the cutting and creasing stations.

Referring now to the Figures, there is shown a carton sizing system 1 according to one embodiment of the invention for adapting the size or configuration of a carton 10 partially filled with one or more products (not shown). The carton sizing system 1 includes a frame 2, a belt conveyor 3, a controller 4 housed in an upper portion 20 of the frame 2, a cutting station 5, a creasing station 6 and a vision system 7.

The frame 2 includes a plurality of frame members 21 interconnected to form a rectangular frame assembly 2 with four adjustable feet 22 at its outer corners and a plurality of panels 23*a*, 23*b* extending across the frame members to enclose the carton sizing system 1. The frame 2 includes two sections, namely a cutting section 24 and a creasing section 25, with a mounting pad 26 secured to the uppermost frame members 21 and extending across the length of the frame 2 to form a roof thereof. The conveyor 3 is mounted to the frame 2 at a vertically raised position and extends across and through the short sides of the enclosure to provide an infeed section 30 and an outfeed section 31, each of which is enclosed by a respective inverted U-shaped guard 32, 33 extending from a respective end panel 23*a* of the frame 2 to a respective end of the conveyor 3.

The cutting station 5 is housed within the cutting section 24 of the frame 2 and includes a six axis articulated robotic arm 50 with a cutter 51 mounted to the end thereof such that the position and orientation of the cutter 51 can be varied to suite an infinite number of configurations. The robotic arm 50 is secured to the underside of the mounting pad 26 and extends downwardly therefrom into the cutting section 24 of the frame 2 toward the conveyor 3.

Figure 3:
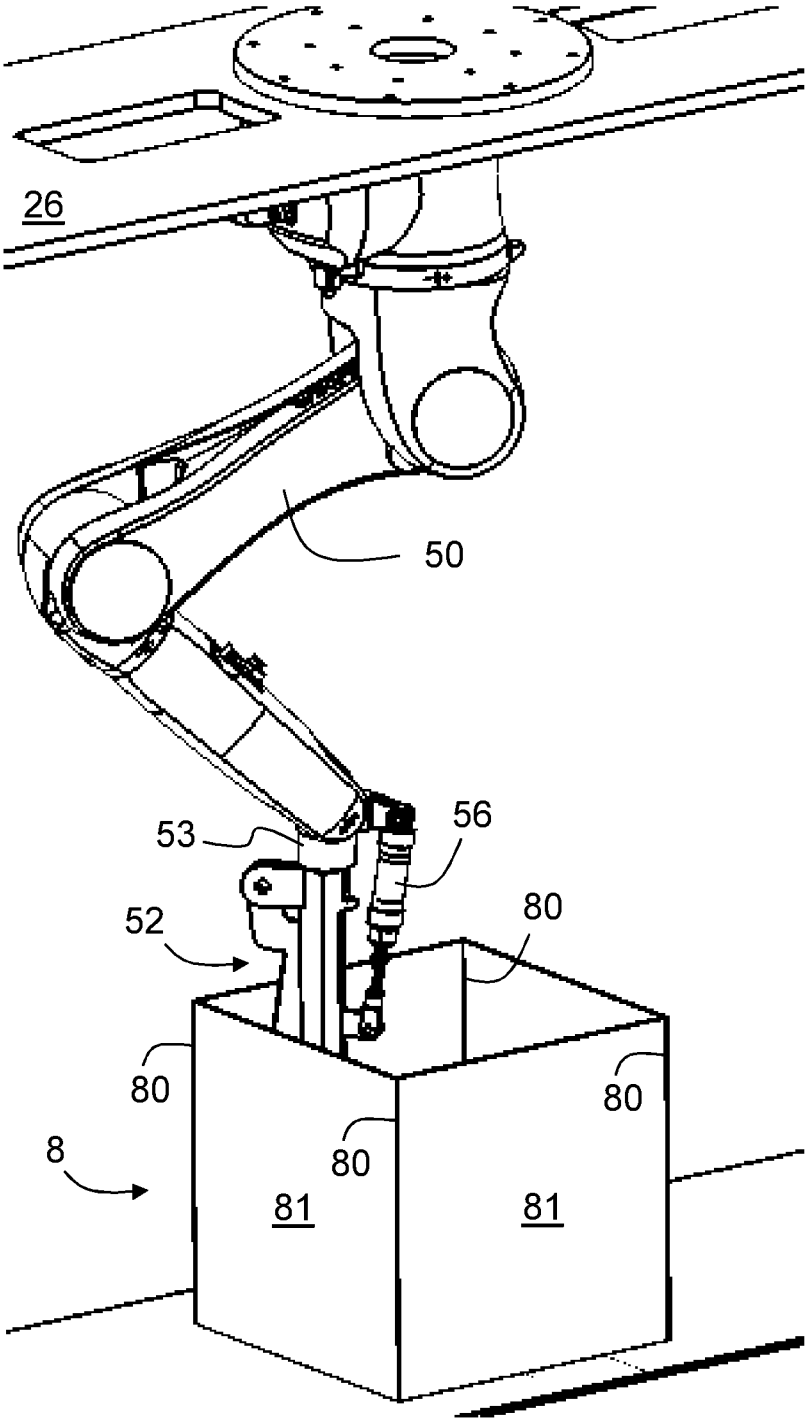
FIG. 3 is a more detailed view of the cutting station of FIGS. 1 and 2.
Figure 4:
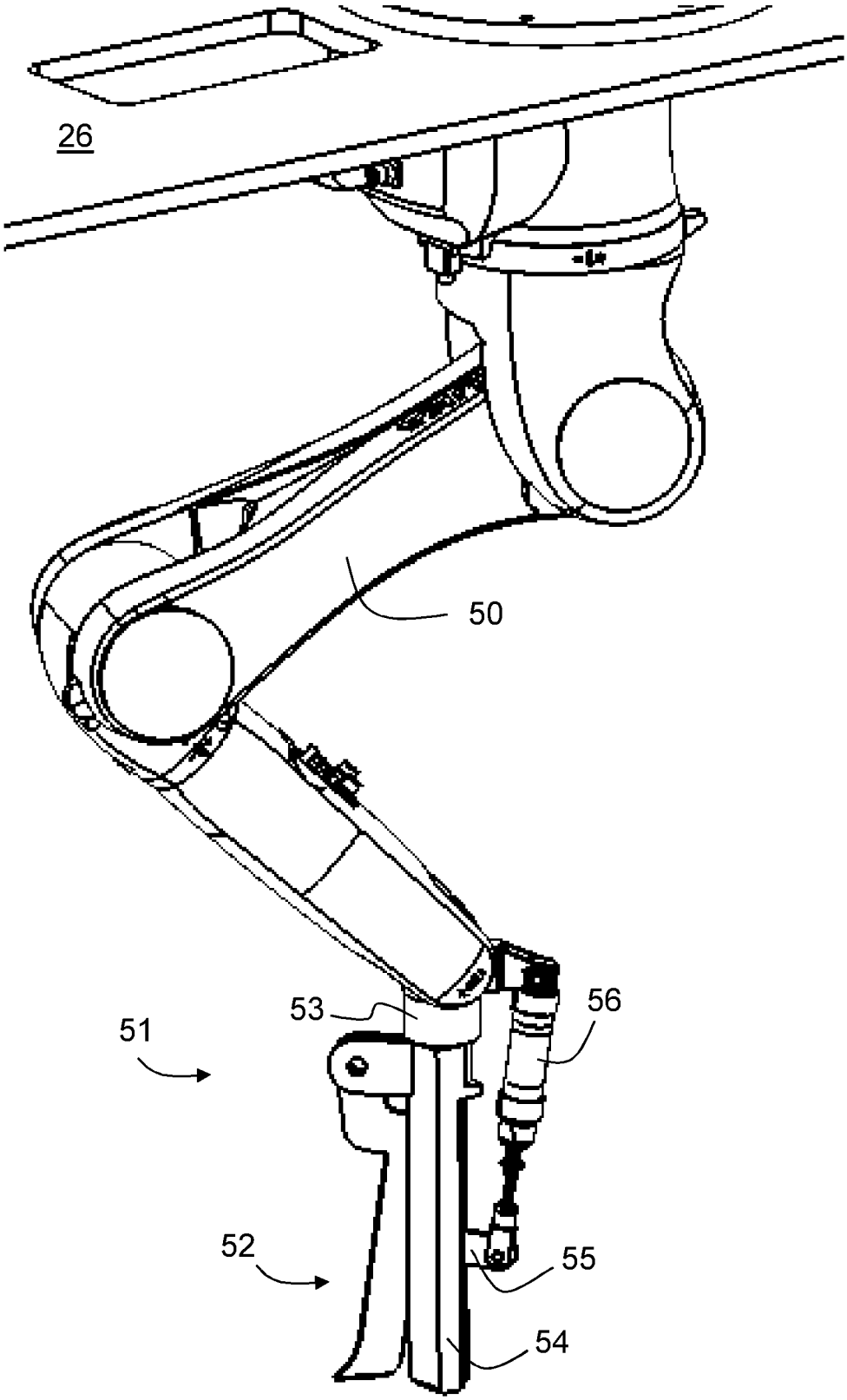
FIG. 4 is a view similar to that of FIG. 3 with the carton omitted to show the cutter.

The cutter 51, shown more clearly in FIGS. 3 and 4, includes a hook shaped blade 52 pivotally mounted to a support block 53 and a pair of guard members 54 secured to the support block 53 and that extend downwardly therefrom on either side of the blade 52. The blade 52 is pivotable between a deployed position in which the front hook and cutting edge of the blade 52 are exposed for cutting and a retracted position (not shown) in which the hook and cutting edge of the blade 52 are concealed and located between the guard members 54. The blade 52 in this embodiment includes an integral extension arm 55 that extends from a rear portion of the blade 52 substantially orthogonally with respect to the cutting edge thereof. The cutter 51 also includes an pneumatic cylinder 56 for moving the blade 52 between the retracted and deployed positions. The cylinder 56 is pivotally connected to the support block 53 at one end and to the extension arm 55 at its other end. The cylinder 56 is operatively connected to and controlled by the controller 4.

The creasing station 6 is housed within the creasing section 25 of the frame 2 and includes a six axis articulated robotic arm 60 with a creaser 61 mounted to the end thereof such that the position and orientation of the creaser 61 can be varied to suite an infinite number of configurations. The robotic arm 60 is secured to the underside of the mounting pad 26 and extends downwardly therefrom into the creasing section 25 of the frame 2 toward the conveyor 3.

Figure 5:
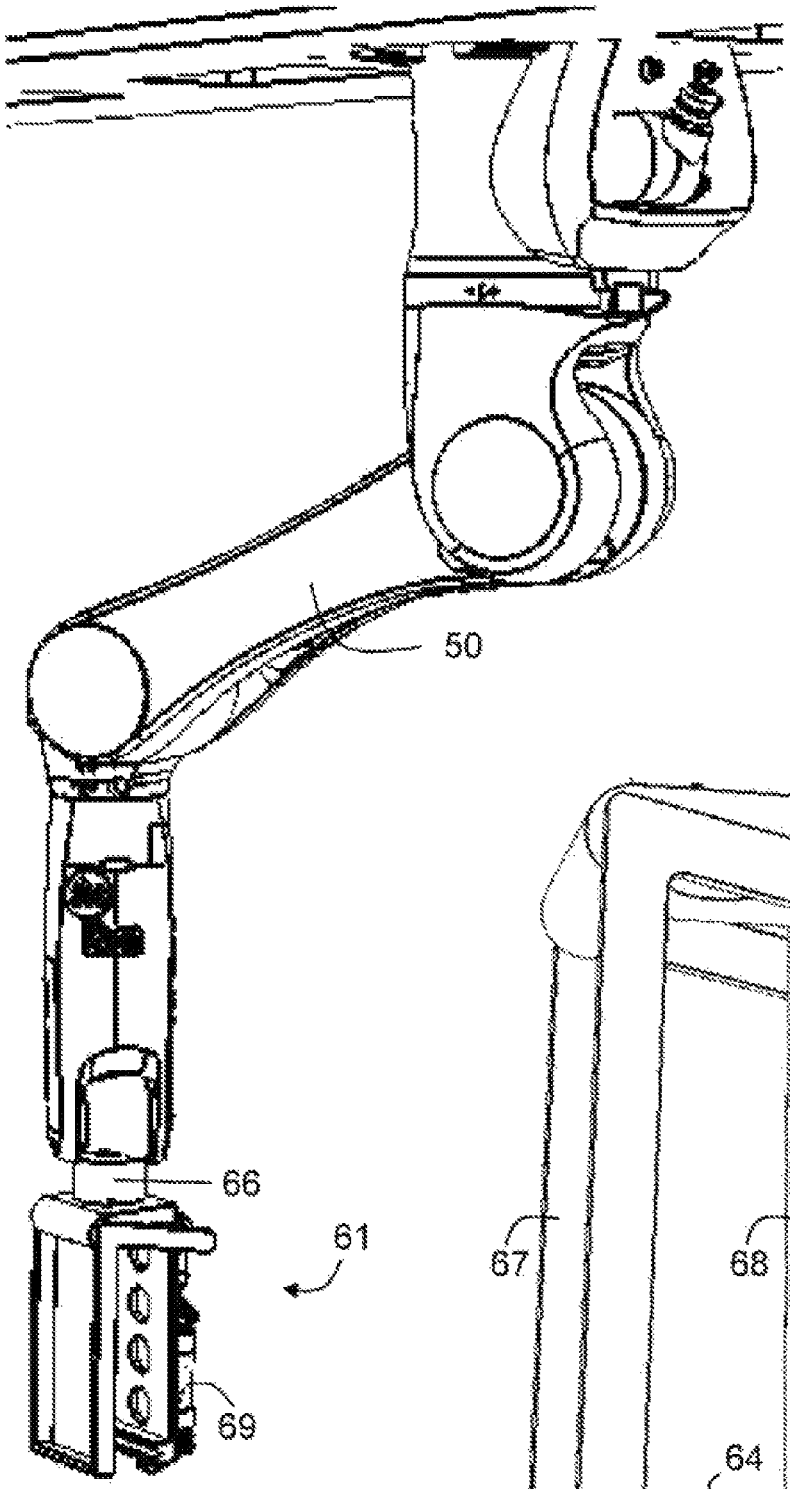
FIG. 5 is a more detailed view of the creasing station of FIGS. 1 and 2 with the carton omitted to show the marker.
Figure 6:
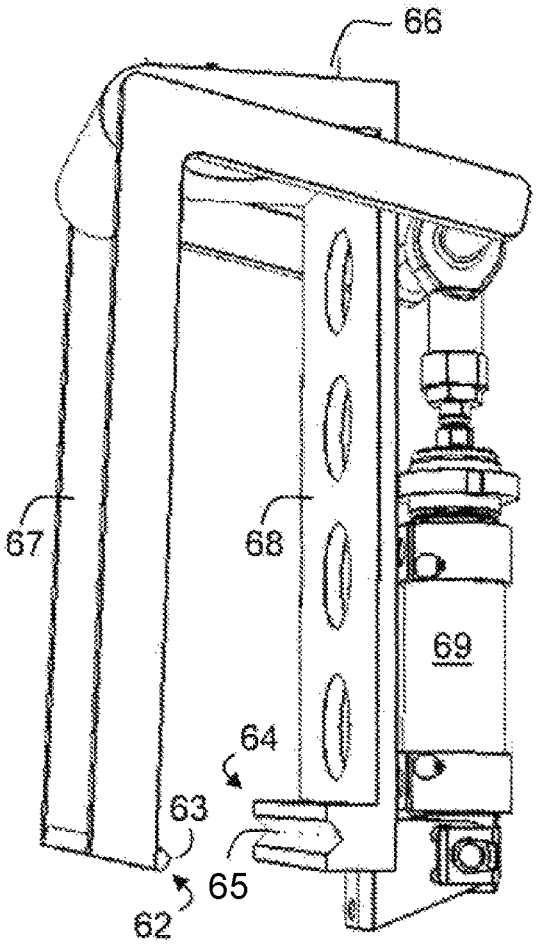
FIG. 6 is a more detailed view of the marker of FIG. 5.

The creaser 61, shown more clearly in FIGS. 5 and 6, includes a blade element 62 with a creasing edge 63, an anvil element 64 with a depression 65 for receiving the creasing edge 63 of the blade element 62 and a base 66. The creasing edge 63 of the blade element 62 is dull in this embodiment for creasing rather than scoring by crushing a carton wall to be creased against the anvil element 64 to create a crease line. The creaser also includes an L-shaped blade arm 67 pivotally mounted at its corner to the base 66 and having an end that the blade element 62 is mounted, an anvil arm 68 fixed or secured relative to the base 66 with an end to which the anvil element 64 is mounted and a pneumatic cylinder 69 for moving the blade arm 67 relative to the anvil arm 68 and base 66 to selectively separate or bring together the creasing edge 63 and depression 65. The cylinder 69 is pivotally connected to an extension portion of the anvil arm 68 that extends orthogonally from the anvil element 64 and to the other end of the L-shaped blade arm 67.

The vision system 7 includes first and second cameras 70 and 71 for capturing images of cartons 8 entering into the infeed section 30 of the conveyor 3 from different respective angles. The first camera 70 is mounted on top of the inverted U-shaped guard 32 of the infeed section 30 of the conveyor 3 and arranged to take an image of the top of a carton 8 as it enters into the infeed section 30 of the conveyor 3. The second camera 71 is mounted on one side of the inverted U-shaped guard 32 of the infeed section 30 of the conveyor 3 and arranged to take an image of the side of a carton 8 as it enters into the infeed section 30 of the conveyor 3.

The vision system 7 is configured to determine from the captured images the height of the contents (not shown) of the carton 8 as well as the width, length and height of the carton 8. These parameters are then sent to the controller 4, which calculates each of the four required start positions and orientations and cutting paths of the cutter 51 to cut the requisite portions of the vertical edges 80 of the carton 8. The controller 4 also calculates each of the required creasing positions and orientations for the creaser 61 to crease the vertical walls 81 of the carton 8.

In use, a partially filled carton 8 enters into the infeed section 30 of the conveyor, images are captured by the cameras 70, 71 of the vision system 7 and the aforementioned parameters are sent to the controller 4, which then calculates automatically the aforementioned start positions, orientations and cutting paths. The carton 8 advances along the conveyor 3 to the cutting station 5 and the controller 4 sends the requisite command signals to the robotic arms 50, 60. With the carton 8 in the cutting station 5, the cutter arm 50 moves the cutter 51 to the first start position and orientation, deploys the cutting blade 52 and cuts the first vertical edge 80. The cutter arm 50 then moves the cutter 51 to each of the other vertical edges and cuts them in turn. The cutter arm 50 then retracts out of the carton 8, which advances to the creasing station 6.

The creaser 61 is moved by the creaser arm 60 to the first start position and orientation, wherein the blade element 62 is positioned adjacent an internal surface of a first of the carton walls 81 between a first two of the vertical edges 80 with the anvil element 64 adjacent a corresponding external surface of the first carton wall 81. The cylinder 69 then actuates the creaser arms 67, 68 to bring the blade and anvil elements 62, 64 together to crease the portion of the wall 81 between them. It will be appreciated that the width of the creaser 61 is significantly less than the width of the carton wall 81 and so the creaser 61 is then operated to separate the blade and anvil elements 62, 64, the creaser 61 is then moved along to the next portion of the wall 81 and the creasing process is repeated. This process is repeated until the crease is formed across the whole of the wall 81 and is then repeated for each of the other carton walls 81. The creaser arm 60 then retracts out of the carton 8, which advances to the outfeed section 31 to be sent to a folding and gluing and/or taping and/or strapping station (not shown).

Figure 7:
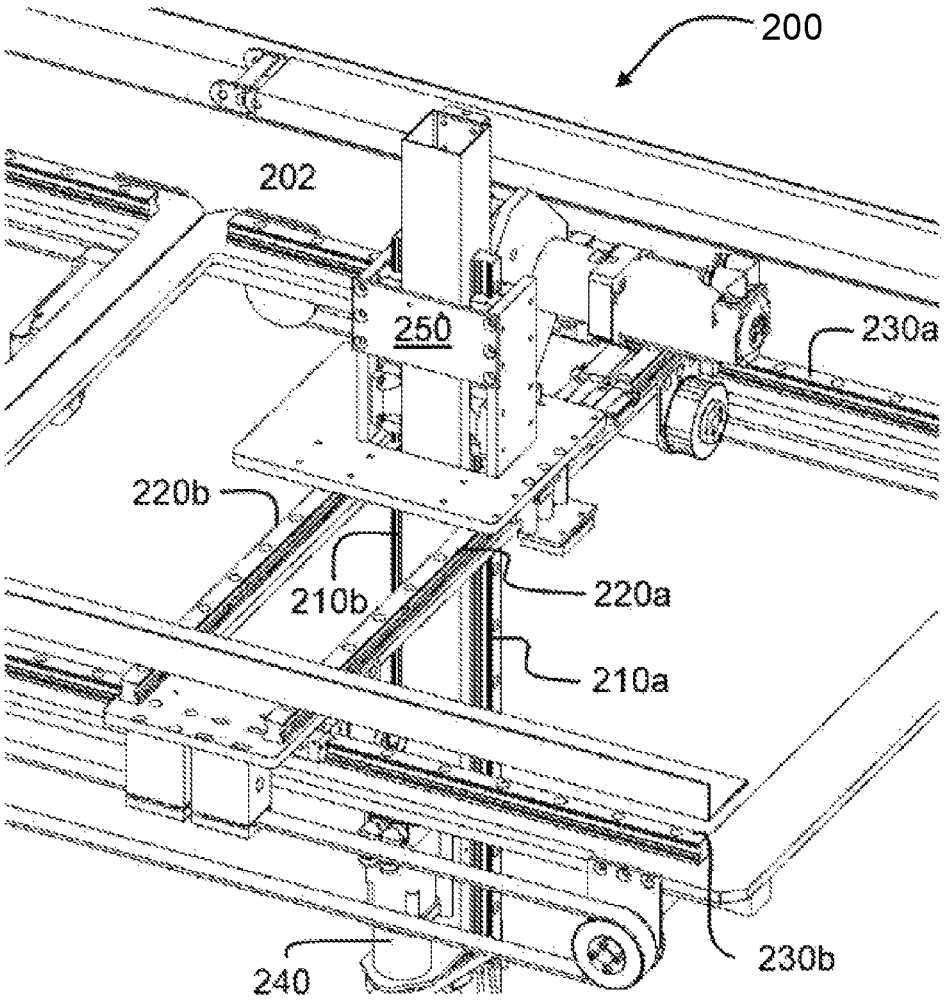
FIG. 7 is a detailed view of a gantry robot positioning system.

Referring now to FIG. 7, there is shown a four axis gantry robot positioning system 200 having a vertical support 202 and housing 250 for adjusting the position of the cutter(s) (not shown) and/or creasers (not shown). The arms (not shown) of cutter(s) (not shown) and/or creasers (not shown) are connected to the positioning system 200 by a rotatable mount 240 that is connected to the vertical support 202 within the frame 2. The rotatable mount 240 allows the position of the cutter (not shown) or creaser (not shown) to be rotated or twisted in use.

The vertical support 202 and housing 250 are mounted on a first pair of guide rails 210*a*, 210*b* such that, in use, the position of the vertical support 202 (and therefore that of the cutter or creaser arm) may be adjusted in a first, vertical, axis.

The positioning system 200 also has a second pair of guide rails 220*a*, 220*b*, along which the position of the vertical support 202 and housing 250 (and therefore that of the cutter or creaser arm) may be adjusted in a second axis that is perpendicular to the first axis.

The positioning system 200 has a further, third, pair of guide rails 230*a*, 230*b*, along which the position of the vertical support 202, housing 250 and second pair of guide rails 220*a*, 220*b* may be adjusted in a third axis. This enables, in use, the position of the cutter or creaser arm (not shown) to be adjusted in a forward or backward direction relative to the direction of travel of the belt conveyor (not shown).

Figure 8:
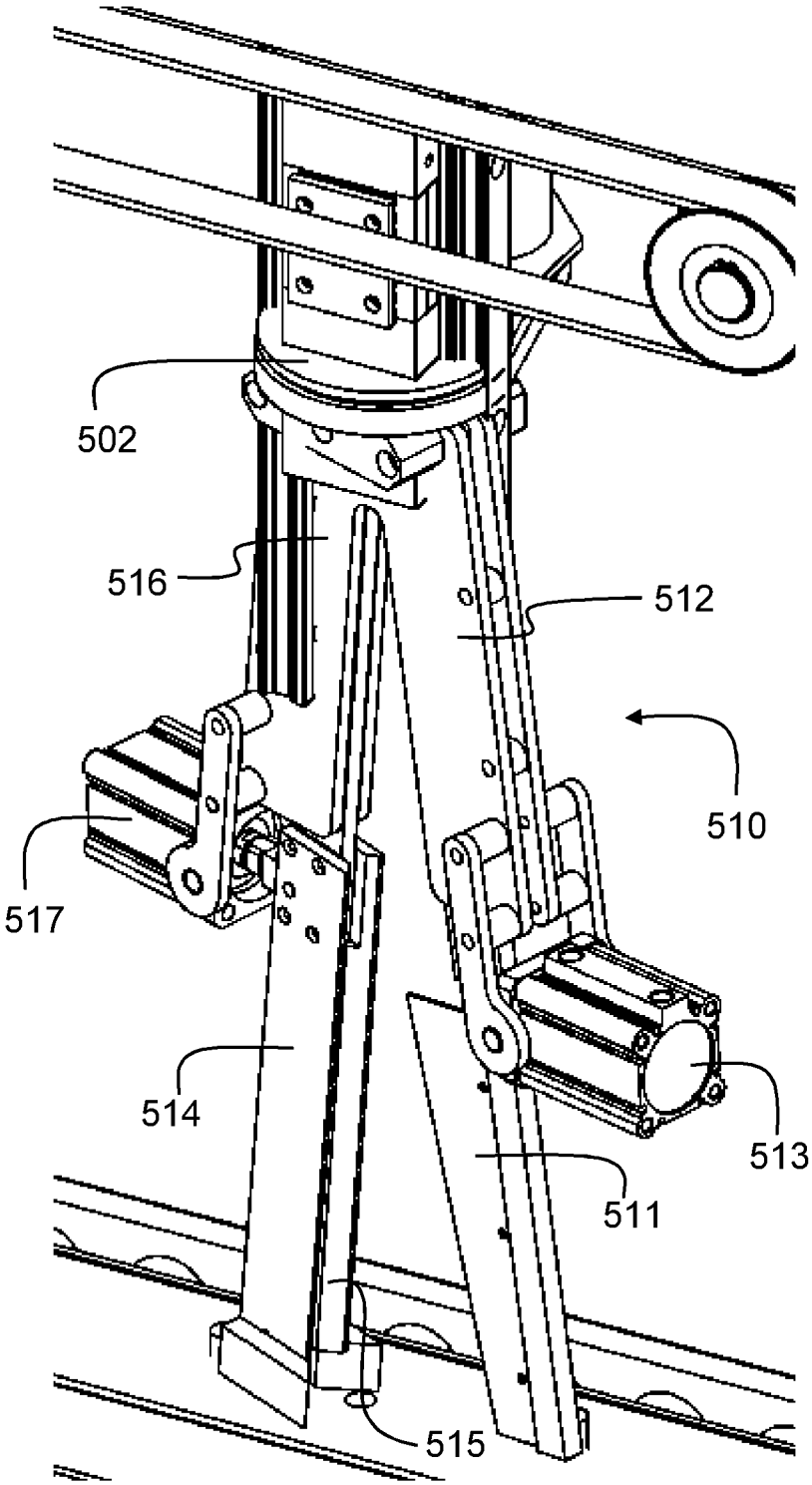
FIG. 8 is a perspective view of a cutting station according to an alternative embodiment.

Referring now to FIG. 8, there is shown an alternative cutter 510 that is suitable for cutting the corners of a carton 8. The cutter 510 includes a blade 511 pivotally mounted to a first arm portion 512 and an anvil element 514 pivotally mounted to a second arm portion 516. The anvil element 514 has a depression 515 for receiving the blade 511 and the cutter 510 is operated by a first actuator 513, while the anvil element 514 is operated by a second actuator 517. The cutter 510 is mounted to a rotating joint 502 such that it may be oriented in any direction. The actuators 513, 517 and the rotating joint 502 are operatively connected to the controller (not shown). In use, the blade 511 is positioned within the box or carton (not shown) to be cut, and the anvil element 514 is positioned on the outside of the box or carton (not shown). Actuators 513 and 517 are operable either individually or in tandem in order to close the blade 511 and anvil element 514 together, thereby cutting any box or carton (not shown) positioned between the two parts.

Figure 9:
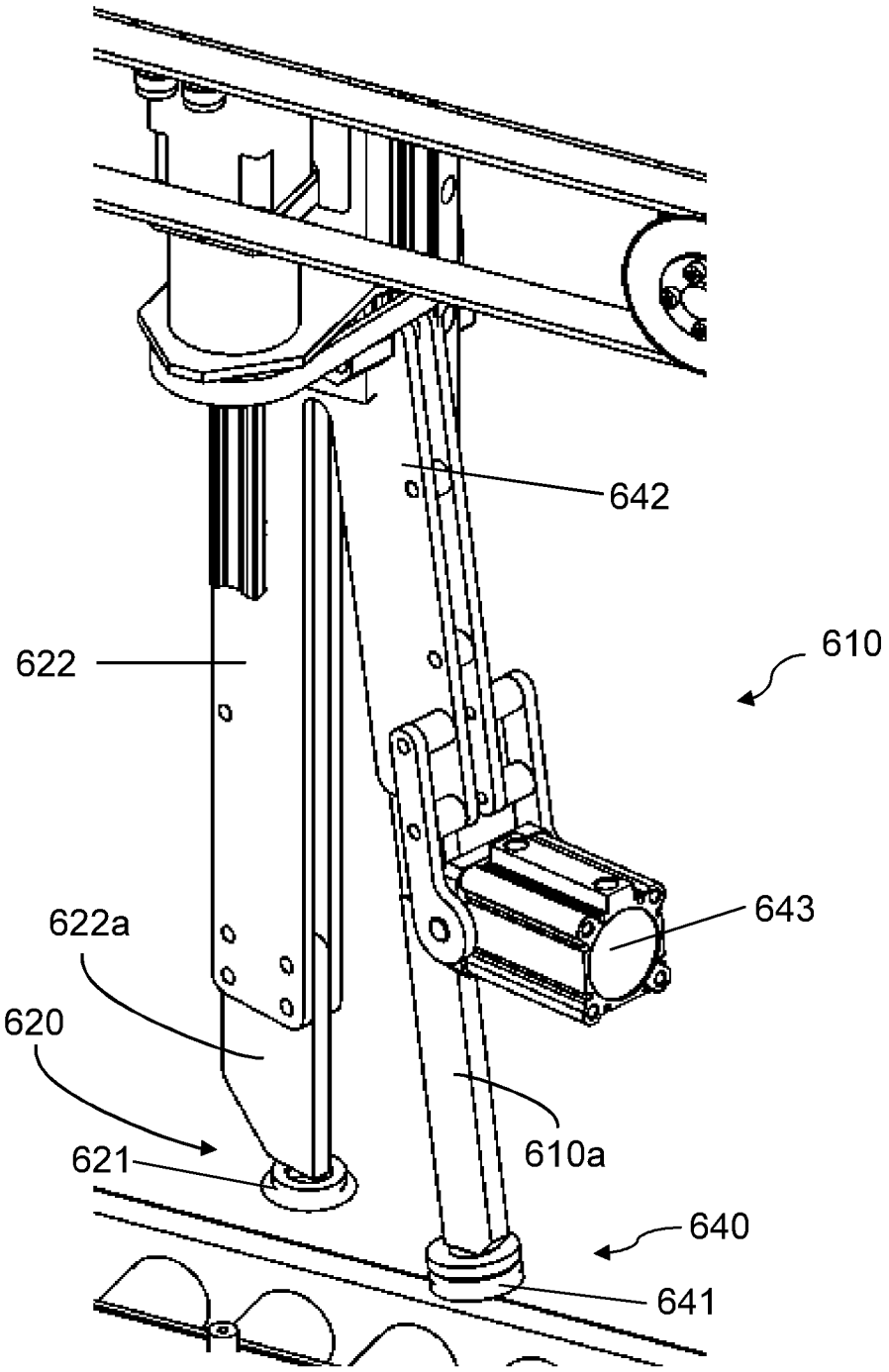
FIG. 9 is a perspective view of a creasing station according to an alternative embodiment.

Referring now to FIG. 9, there is shown an alternative creaser 610. The creaser 610 comprises first and second rollers 620 and 640 mounted to respective first and second arm portions 622, 642. A first roller 620 is rotatably mounted to a fixed extension 622*a* of the first arm portion 622 and includes a creasing edge 621. A second roller 640 is rotatably mounted to a movable extension 642 that is pivotally mounted to the second arm portion 642 and operated by an actuator 643. The second roller 640 provides an anvil member with a depression 641 for receiving the creasing edge 621 of the first roller 620. The creasing edge 621 of the roller 620 is dull in this embodiment for creasing rather than scoring by crushing a carton wall to be creased against the anvil element 641 to create a crease line. The actuator 643 is operatively connected to the controller (not shown) and drives the anvil member 640 toward the roller 620 for effecting a crease. Both the roller 620 and anvil member 640 are circular and rotatable, such that in use the two may be brought together to form a crease and moved along a carton 8 to form a single crease without requiring repeated opening and closing motions. In a further alternative embodiment, the roller 620 has a series of sharp blades (not shown) about its circumference at regular intervals so that as the blade is run along the carton surface it creates a perforated line.

It will be appreciated by those skilled in the art that several variations to the embodiments described herein are envisaged without departing from the scope of the invention. For example, while the marker of this embodiment is a creaser 61 it may be replaced with a scorer or scoring means, for example a sharp blade (not shown) that may include a plurality of teeth (not shown) for creating perforations in the carton 10. Additionally or alternatively, the measuring means need not be provided by a vision system 7. It may, for example comprise one or more sensors for measuring or determining, in use, one or more dimensions of the container or carton or its contents. The container need not be a carton 8, it may be any other suitable container for which the present invention may be useful.

The system 1 may also include any one or more of a carton blank feeding station, an erecting station, a folding and/or closing and/or gluing and/or taping station, a strapping station, a stacking station and a palletising station.

It will also be appreciated by those skilled in the art that any number of combinations of the aforementioned features and/or those shown in the appended drawings provide clear advantages over the prior art and are therefore within the scope of the invention described herein.

The above exemplary embodiments of the present invention have been described with reference to numerous directional terms such as "top", "bottom", "side", "end", "upper", inwardly", "upwardly", "vertical", etc. It is to be understood that these directional terms are used purely for the benefit of aiding clarity of the description of the exemplary embodiments and are in no way limiting to the scope of the disclosure.

The invention claimed is:

1. A carton sizing system for sizing open top cartons having different widths and lengths, the system comprising:

a frame;

a controller;

one or more cutters movably mounted to the frame and operatively connected to the controller, the one or more cutters being movable in a first horizontal direction, a second horizontal direction perpendicular to the first horizontal direction, and a vertical direction perpendicular to the first and second horizontal directions such that the same cutter(s) can be repositioned to accommodate different carton widths and lengths;

one or more markers movably mounted to the frame, each marker being mounted to a robotic arm and comprising a pair of marker elements for compressing and marking a carton wall therebetween to score or crease the carton wall, the robotic arm(s) being operatively connected to the controller and configured to move, in use, the marker element pair mounted thereto in the first horizontal direction, the second horizontal direction, and the vertical direction such that the same marker element pair can be repositioned to accommodate different carton widths and lengths; and a measurement system operatively connected to the controller and configured to determine, in use, a width and a length of an open top carton and to determine a height of one or more objects contained within the open top carton;

wherein the controller is configured to:

move the one or more cutters and the one or more marker element pairs in the first horizontal direction based on the determined width of the open top carton;

move the one or more cutters and the one or more marker element pairs in the second horizontal direction based on the determined length of the open top carton;

cause the one or more cutters to cut vertical edges of the open top carton based on the determined height of the one or more objects contained within the open top carton;

cause the robotic arm(s) to move the one or more marker element pairs in the vertical direction based on the determined height of the one or more objects contained within the open top carton; and cause the one or more marker element pairs to score or crease vertical walls of the open top carton between the vertical edges to at least partially define foldable flaps or panels.

2. Carton sizing system according to claim 1, wherein each of the one or more cutters is mounted to a robotic arm, the robotic arm(s) to which the marker(s) and cutter(s) are mounted each comprising an articulated arm movable in three or more axes.

3. Carton sizing system according to claim 1, wherein each of the one or more cutters is mounted to a robotic arm of a cartesian robot ora robotic gantry system.

4. Carton sizing system according to claim 1, wherein each of the one or more cutters comprises a blade movably mounted to a support and a guard mounted to the support, wherein the blade is movable between a deployed position in which a corner or edge of the blade is exposed for cutting and a retracted position in which it is at least partially covered or concealed by or within the guard.

5. Carton sizing system according to claim 1, wherein the controller is configured to position, in use, the cutter or one of the cutters to cut a first vertical edge of the open top carton and then to position the same cutter to cut a second vertical edge of the same open top carton, different from the first vertical edge.

6. Carton sizing system according to claim 5, wherein the controller is configured to position, in use, the same cutter to cut each of the vertical edges of the same open top carton in sequence.

7. Carton sizing system according to claim 1, wherein the robotic arm(s) comprise part of a cartesian robot or a robotic gantry system.

8. Carton sizing system according to claim 1, wherein the pair of marker elements comprises a blade element and an anvil element against which the blade element may be urged to create a crease or score mark or line, the blade element or the anvil element having a width which is less than that of a wall of the open top carton to be creased such that each open top carton wall to be creased is creased multiple times.

9. Carton sizing system according to claim 1, wherein the measurement system comprises one or more sensors for determining, in use, one or more dimensions of the open top carton.

10. Carton sizing system according to claim 1, wherein the controller is configured to position, in use, the marker or one of the markers to score or crease a first vertical wall of the open top carton and then to position the same marker to score or crease a second vertical wall of the same open top carton, different from the first vertical wall.

11. Carton sizing system according to claim 10, wherein the controller is configured to position, in use, the same marker to score or crease each of the vertical walls of the same open top carton in sequence.

12. Carton sizing system according to claim 10, wherein the controller is configured to position, in use, the same marker to score or crease different portions of the first or each vertical wall of the same open top carton in sequence.

13. Carton sizing system according to claim 1, wherein the measurement system comprises an imaging system configured to capture, in use, one or more images from one or more positions or angles and to determine or measure from each of the one or more captured images one or more features or dimensions of the open top carton or the one or more objects contained with the open top carton.

14. Carton sizing system according to claim 13, wherein the imaging system is configured to determine or measure from each of the one or more captured images a height of one or more objects contained within the open top carton and a width and length of the open top carton.

15. Carton sizing system according to claim 13, wherein the controller is configured to determine or calculate one or more required cutter positions and one or more required cutter orientations for cutting each of the vertical edges of the open top carton based on the determined or measured feature(s) or dimension(s) of the open top carton or the one or more objects contained within the open top carton.

16. Carton sizing system according to claim 13, wherein the controller is configured to determine or calculate one or more required marker positions and one or more required marker orientations for scoring or creasing each of the vertical walls of the open top carton based on the determined or measured feature, the determined or measured features, the determined or measured dimension, or the determined or measured dimensions of the open top carton or the one or more objects contained within the open top carton.

17. A method of forming a carton comprising the steps of:

determining a width and a length of an open top carton using a measurement system:

determining a height of one or more objects contained within the open top carton using the measurement system;

automatically determining a position of vertical edges of the open top carton based on the determined width and length of the open top carton using a controller:

automatically determining a required height of the open top carton based on the determined height of the one or more objects using the controller;

causing the controller to:

move one or more cutters in a first horizontal direction based on the determined width of the open top carton and in a second horizontal direction, perpendicular to the first horizontal direction, based on the determined length of the open top carton to a position adjacent each of the vertical edges;

cause the one or more cutters to cut each of the vertical edges between an upper edge of the open top carton and a position at or adjacent a required carton height based on the determined height of the one or more objects contained within the open top carton;

cause each of one or more robotic arms to move a respective marker element pair in the first horizontal direction based on the determined width of the open top carton and in the second horizontal direction based on the determined length of the open top carton; and score or crease vertical walls between the vertical edges of the open top carton using the one or more marker element pairs by compressing and marking each vertical wall therebetween at a position at or adjacent the required carton height such that one or more foldable flaps or panels are defined in the vertical walls.

18. A carton sizing system comprising:

a frame;

a controller;

one or more cutters movably mounted to the frame and operatively connected to the controller, each of the one or more cutters being movable in three or more axes such that the same cutter(s) can be repositioned to accommodate different carton widths and lengths;

one or more markers movably mounted to the frame, each marker being mounted to a robotic arm and comprising a pair of opposed marker elements, the robotic arm(s) being operatively connected to the controller and configured to move, in use, the marker element pair mounted thereto in three or more axes such that the same marker element pair can be repositioned to accommodate different carton widths and lengths; and one or more sensors operatively connected to the controller and configured to determine, in use, a width and a length of an open top carton and to determine a height of one or more objects contained within the open top carton;

wherein the controller is configured to:

move the one or more cutters along the three axes based on the determined width and length of the open top carton and based on the determined height of the one or more objects contained within the open top carton;

cause the one or more cutters to cut vertical edges of the carton based on the determined height of the one or more objects contained within the open top carton; and cause the one or more marker element pairs to score or crease vertical walls of the open top carton between the vertical edges by compressing and marking each vertical wall therebetween to at least partially define foldable flaps or panels.

19. Carton sizing system according to claim 18, wherein each of the one or more cutters is mounted to a robotic arm, the robotic arm(s) to which the marker(s) and cutter(s) are mounted each comprising an articulated arm movable in three or more axes.

20. Carton sizing system according to claim 18, wherein each of the one or more cutters is mounted to a robotic arm, the robotic arm(s) to which the marker(s) and cutter(s) are mounted each comprising a robotic arm of a cartesian robot or a robotic gantry system.

* * * * *